US005645373A

United States Patent [19]

Jenkins

[11] Patent Number: 5,645,373

[45] Date of Patent: Jul. 8, 1997

[54] FLOOD CONTROL BARRIER SYSTEM AND METHOD

[75] Inventor: John T. Jenkins, Irving, Tex.

[73] Assignee: Maca/Orsi, L.L.C., El Paso, Tex.

[21] Appl. No.: 499,599

[22] Filed: Jul. 11, 1995

[51] Int. Cl.[6] ..... E02B 7/20

[52] U.S. Cl. ..... 405/91; 405/114

[58] Field of Search ..... 405/114, 91, 52, 405/60, 63, 66–68

[56] References Cited

U.S. PATENT DOCUMENTS

| | | | |
|---|---|---|---|
| 3,710,943 | 1/1973 | Davidson et al. | 210/242 |
| 3,975,915 | 8/1976 | Haw | 405/107 X |
| 4,295,756 | 10/1981 | Blair | 405/70 |
| 4,752,393 | 6/1988 | Meyers | 210/242.3 |
| 4,981,391 | 1/1991 | Klementovich | 405/52 |
| 5,022,785 | 6/1991 | Goans | 405/69 |
| 5,059,065 | 10/1991 | Doolaege | 405/115 |
| 5,125,767 | 6/1992 | Dooleage | 405/115 |
| 5,139,363 | 8/1992 | Jenkins | 405/63 |
| 5,238,327 | 8/1993 | Blair et al. | 405/68 |
| 5,312,204 | 5/1994 | Goans | 405/68 |

FOREIGN PATENT DOCUMENTS 27 28 835 1/1979 Germany .

OTHER PUBLICATIONS

Shoreguardian boom brochure of Burlington Enviromental (Vikoma International).

Versatech Products, Inc. ShoreSeel Boom brochure.

*Primary Examiner*—Tamara L. Graysay

*Assistant Examiner*—Tara L. Mayo

*Attorney, Agent, or Firm*—Akin, Gump, Strauss, Hauer & Feld, L.L.P.

[57] ABSTRACT

A temporary flood control barrier system comprising elongated flexible, inflatable, tubular ballast members secured to each other and adapted to be disposed on the earth's surface for anchoring a generally sheetlike vertically extendable barrier wall or an inflatable tubular barrier member disposed above and connected to the ballast members. The ballast members are at least partially fillable with a dense ballast liquid, such as water, and may be inflated with pressure air to add rigidity and increase the height of the flood control barrier system. The sheetlike barrier wall is held erect by spaced apart support poles and sets of flexible retaining lines also attachable to the barrier wall at spaced apart points. An elongated skirt or liner is attached to one side of one of the ballast members and is deployable on the floodwater side of the barrier system to minimize saturation and erosion of the earth's surface adjacent to the ballast members. The liner may be secured by elongated plate retainers and spiral auger type anchors. Substantially rigid connectors are adapted to connect the barrier sections end to end.

21 Claims, 4 Drawing Sheets

FLOOD CONTROL BARRIER SYSTEM AND METHOD

FIELD OF THE INVENTION

The present invention pertains to a flexible fabric barrier system which is easily transportable and may be temporarily erected to prevent flooding of an area or to deflect the course of flood waters.

BACKGROUND OF THE INVENTION

The continued development of terrain which is subject to flooding has heightened the need for temporary flood control barriers which may be easily transported, quickly erected at the desired site and then disassembled when the need for flood protection is relieved. High-yield crop land, for example, is typically found in the floodplains of significant rivers of the world. Although a substantial amount of such crop land is normally protected from flooding by permanent earth dikes or levees, such levees are often inadequate and are subsequently breached causing flooding of large areas of land which has various kinds of development thereon including residential and commercial structures, roadways, railroads, and virtually all forms of civilian development. Such development also takes place in flood prone areas which are not protected from flooding by permanent dikes or levees.

The time available to provide at least temporary flood. protection for structural developments in flood prone areas may range from hours to several days. For example, during the severe flooding of the Mississippi River floodplains in July, 1993 predicted flood levels or "crests", particularly downstream of the source of flooding, were available several days prior to the critical flood period. In this case, attempts to protect many structures in floodplain areas behind the threatened levees or dikes were unsuccessful in that sand bag barriers or temporary earthen dikes or levees were quickly breached once the flood waters impinged on these structures. However, the permanent earthen levees or dikes were, in many cases, topped by the rising flood waters and efforts to increase the height of these levees using wooden planks, sandbags, or temporary sand or earth fill were largely unsuccessfully. Moreover, the erection of sandbag and earth-fill barriers are labor and equipment intensive and time consuming and such structures can rapidly become saturated and structurally weakened to the point of failure. Still further, they create a problem with respect to removal after the flood-waters have subsided.

Accordingly, the aforementioned continued development of floodplain and other flood prone areas has created a need for temporary flood control barriers which are easily transported and erected, are not subject to structural weakening from water saturation, are not particularly labor or equipment intensive, and may be removed and reused when needed. It is to these ends that the present invention has been developed.

SUMMARY OF THE INVENTION

The present invention provides a unique flood control barrier system and method of deployment which provides a rapidly deployable temporary barrier or dam to prevent encroachment of floodwaters on an area desired to be protected or to at least deflect the flow of floodwater away from a structure or area to minimize damage thereto.

In accordance with one aspect of the invention a flood control barrier is provided which is characterized by one or more. elongated fluid filled tubular ballast members which may be interconnected to form a barrier to enclose a structure or area to be protected from rising floodwater. The fluid filled ballast members comprise elongated reinforced plastic tubes which may be at least partially filled with a dense fluid such as water, and may be easily deployed to form an enclosure or a flow diversion barrier. The ballast members or tubes may also be attached to a vertically extendable, generally planar barrier member which may be supported by spaced apart support members including detachable poles and spaced apart flexible restraining lines.

In accordance with another aspect of the invention a temporary flood control barrier is provided which includes elongated fluid filled ballast members having attached thereto a generally flexible sheetlike skirt or liner which may be deployed on the earth's surface adjacent the ballast member and exposed to rising floodwater to minimize saturation and/or erosion of the earth directly adjacent to the barrier.

The temporary flood barrier system of the invention is also adapted to be easily transported, deployed in elongated sections which are connected end to end to form an enclosure, and filled with fluids, such as water, to provide ballast for maintaining the barrier in firm contact with the ground.

Still further, the present invention provides a method for erecting a temporary flood control barrier utilizing flexible and foldable barrier sections which may be interconnected to form a continuous barrier enclosing a predetermined area to prevent flooding, to act as a barrier to deflect floodwater away from a structure, or to prevent floodwaters from topping existing earthen levees, dikes, dams, or other structures.

The improved flood control barrier system, and its method of deployment provides an easily transportable and deployable system which may be erected on short notice in the event of rapidly rising floodwater or threatening conditions, may be easily disassembled and removed from the flood control site, is not subject to rapid deterioration, such as by water saturation, and subsequent failure, is not particularly labor or capital intensive and may be stored long term for use on short notice. These advantages and superior features together with other important aspects of the invention will be further appreciated by those skilled in the art upon reading the detailed description which follows in conjunction with the drawing.

DESCRIPTION OF THE PREFERRED EMBODIMENTS

Figure 1:
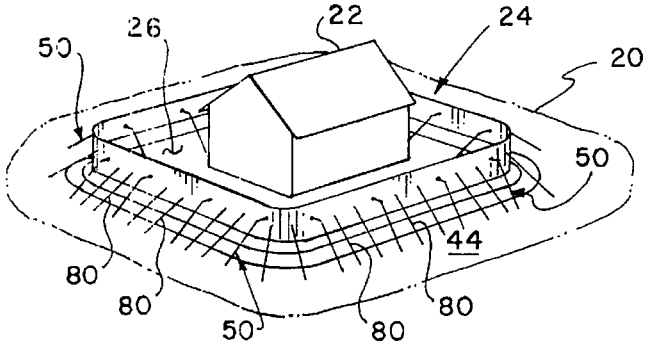
FIG. 1 a perspective view of a floodplain area and structure which is protected by a flood control barrier system in accordance with the invention.

In the description which follows, like elements are marked throughout the specification and drawing with the same reference numerals, respectively. The drawing figures are not necessarily to scale and certain features may be shown in somewhat schematic or simplified form in the interest of clarity and conciseness.

Referring to FIG. 1, there is illustrated a portion of flood prone terrain 20 having a building 22 disposed thereon and enclosed by a unique temporary flood control barrier system in accordance with the invention and generally designated by the numeral 24. The barrier system 24 is, in the embodiment illustrated in FIG. 1, shown erected to form a complete enclosure of an area 26 of the flood prone terrain 20 which will remain substantially free of floodwater as a result of erection of the barrier system 24. In a typical temporary flood control situation, minor flow from ground seepage under the barrier system 24 or very minor leakage flow between sections of the barrier system to be described herein may occur and can be tolerated. However, for at least temporary flooding conditions, the barrier system 24 may be easily deployed and erected, as will be appreciated from a description herein, to protect the building 22 from flooding.

Figure 2:
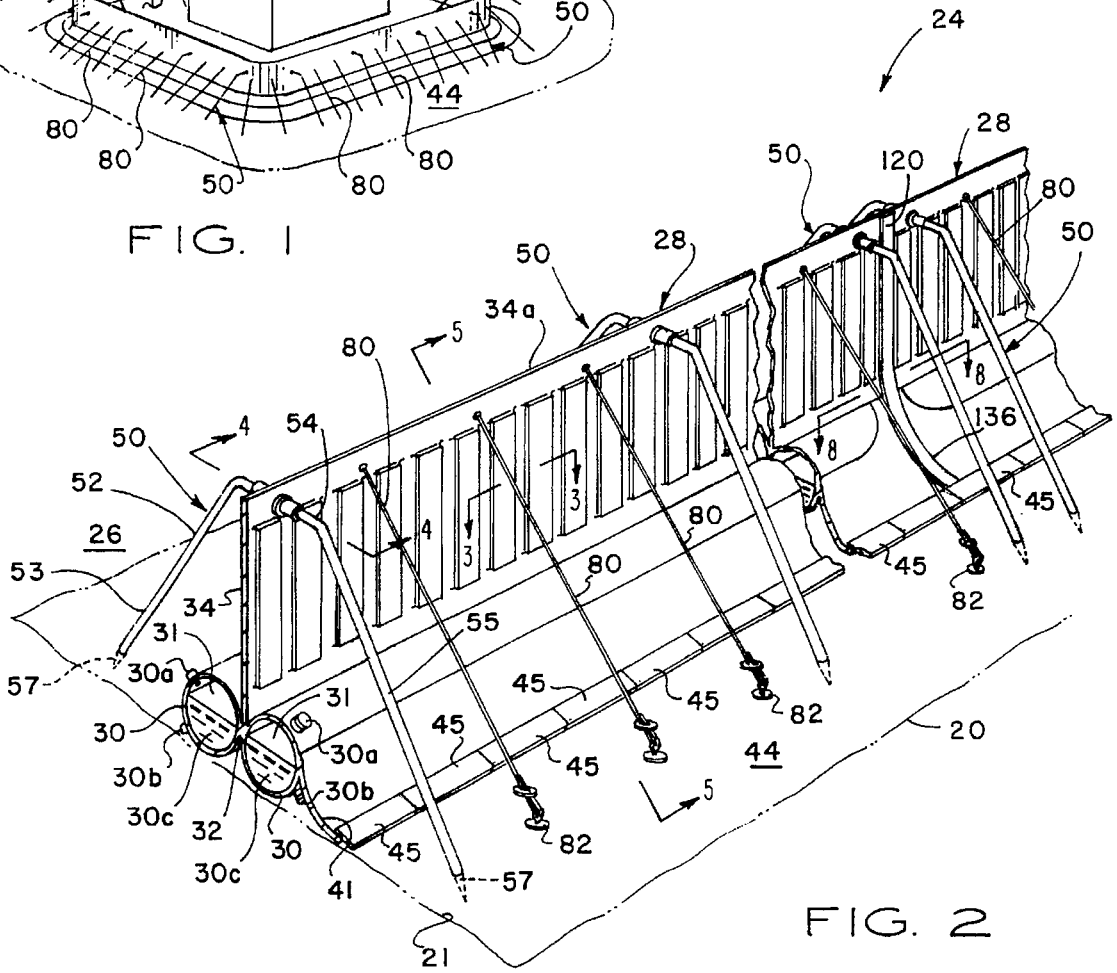
FIG. 2 is a perspective view of a portion of the flood control barrier system shown in FIG. 1.
Figure 3:
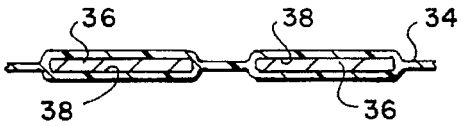
FIG. 3 is a section view taken generally along the line 3—3 of FIG. 2.

FIG. 2 shows a portion of the flood control barrier system 24 in further detail. The barrier system 24 is preferably made up of elongated barrier sections 28 which are coupled end to end and can be arranged to form the continuous barrier system illustrated in FIG. 1. Each barrier section 28 is preferably made up of elongated flexible and inflatable ballast means comprising, in the embodiment shown, two, side by side, generally cylindrical tubular members 30 which are suitably joined together at a junction 32. The ballast members 30 are also connected to a generally vertically extendable barrier wall member 34 which is substantially co-extensive with the ballast members 30 and, like the members 30, is preferably formed of a flexible virgin or fabric reinforced plastic material such as polyurethane, vinyl or polyethylene. As shown in FIG. 3, the wall member 34 may be provided with vertically extending, relatively stiff, spaced apart battens 36 suitably disposed in pockets 38 formed in the wall member. The ballast members may have a diameter of between two feet and five feet and the height of the barrier wall may be up to ten feet, for example. The barrier sections 28 may be from thirty feet to one hundred feet in length.

Figure 8:
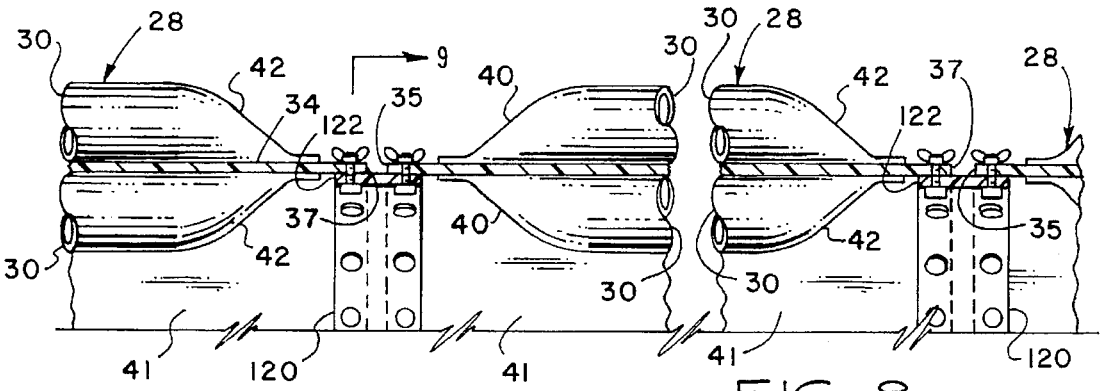
FIG. 8 is a section view taken from the line 8—8 of FIG. 2.
Figure 9:
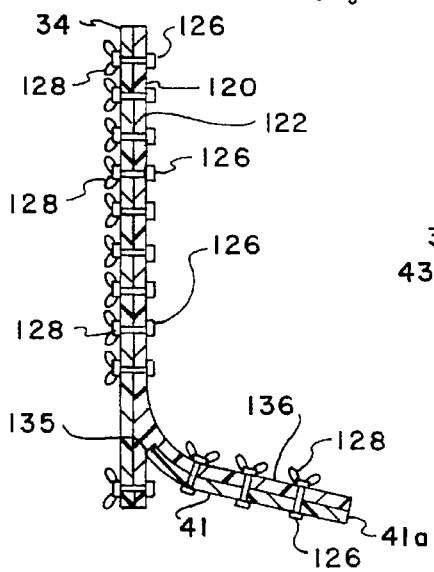
FIG. 9 is a section view taken from the line 9—9 of FIG. 8.
Figure 9A:
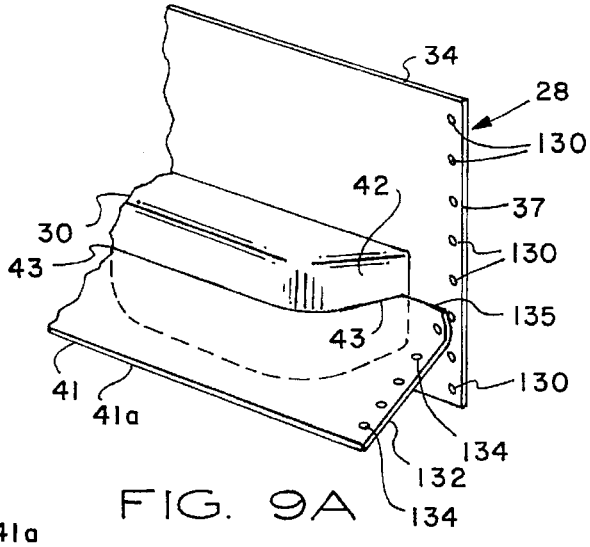
FIG. 9A is a detail view of an end portion of one of the barrier sections shown in FIG. 2.

Referring briefly to FIGS. 8 and 9A, each barrier section 28 is formed to have opposed tapered ends 40 and 42 of the respective ballast members 30 which delimits the longitudinal extent of the ballast members and which form closures for opposite ends of the ballast members. The wall member 34 extends beyond the tapered ends 40 and 42 of each of the ballast members and is delimited by opposed distal side edges 35 and 37 which are adapted to be connected to suitable connectors for joining the barrier sections 28 to each other, as indicated in FIG. 8, and which will be described in further detail hereinbelow.

Referring further to FIG. 2, each barrier section 28 is provided with an elongated flexible skirt or liner member 41 which is suitably attached to one side of a ballast member 30, as indicated at 43, and which is substantially co-extensive with the wall member 34 throughout the length of a barrier section. The liner 41 extends laterally from one side of the barrier section 28 and is preferably formed of a virgin or fabric reinforced plastic, the same material of which the members 30 and 34 are formed. Each liner 41 is preferably secured to the ground surface 21 by elongated, generally flat rectangular retainer plates 45 which are suitably secured to the surface 21 as will be described hereinbelow. The liner 41 provides a seal which minimizes saturation of the earth's surface 21 directly adjacent the barrier system 24 and also minimizes erosion of the soil at the barrier system to reduce the chance of water tending to flow under the ballast members 30 from the potentially floodable side 44 of the barrier to the space or enclosure 26, for example.

As shown in FIG. 2, the ballast members 30 each have respective fluid fill and drain ports 30*a* and 30*b* which provide for filling the interior spaces 31 of the ballast members at least partially with a suitable ballast fluid, such as water, as indicated by numeral 30*c* in FIG. 2. The remaining space within the interior of the ballast members 30 may also be filled with pressure air to maintain the ballast members substantially rigid and erect. Suitable fittings may be provided for the ports 30*a*and 30*b* to control inflow and outflow of fluid with respect to the interior spaces 31 of the respective ballast members.

Figure 4:
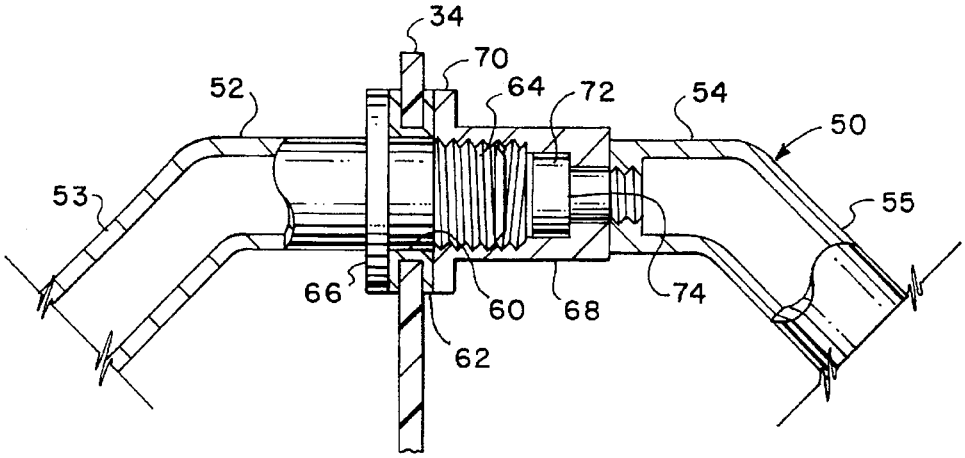
FIG. 4 is a detail section view taken generally from the line 4—4 of FIG. 2.

Referring further to FIG. 2, and also FIG. 4, each barrier section 28 includes a plurality of spaced apart barrier wall support pole assemblies 50 which aid in holding the barrier wall 34 substantially erect in a vertical plane. The support pole assemblies 50 are characterized by opposed tubular metal support poles 52 and 54 which are suitably connected to each other and to the barrier wall 34 and include a depending leg portions 53 and 55, respectively, each having a tapered end 57 for penetration into the earth's surface 21 to stabilize the support pole assembly.

As shown by way of example in FIG. 4, the barrier wall 34 is provided with spaced apart means defining suitable circular openings 60, which means may comprise metal grommets 62 of conventional construction and suitably secured to the barrier wall. The barrier wall support pole 52 includes a distal threaded end portion 64 which extends from a generally cylindrical support collar 66, as shown. The support pole 54 includes a distal end portion defined by a rotatable nut 68 also having a wall engaging collar 70 and rotatably journaled on a cylindrical extension 72 of the pole 54 and having a suitable retaining flange 74 formed thereon for retaining the nut connected to the pole 54 but rotatable relative thereto. The support pole assembly 50 may be secured to the barrier wall 34 by projecting the distal end 64 through the opening 60 and tightening the nut 68 of pole 54 thereon to forcibly engage the grommet 62. In this way the poles 52 and 54 may be extended in a generally vertical plane in forcible engagement with the ground and with the barrier wall to support same. One or the other of the poles 52 or 54 may be disposed at a certain angle other than the vertical to accommodate variations in terrain. The pole leg sections 53 and 55 both depend at suitably inclined directions with respect to the distal ends 64 and 72 of the poles. The connection between the support poles 52 and 54 of the support pole assembly 50 illustrated in FIG. 4 and described above is exemplary and advantageous and other means for interconnecting the support poles 52 and 54 may be utilized within the scope of the present invention. The barrier support pole assemblies 50 are preferably spaced apart along the barrier wall 34 at distances of about 15 to 20 feet. Different spacings may be required depending on whether or not the barrier system 24 is expected to withstand severe wave action or currents.

Figure 5:
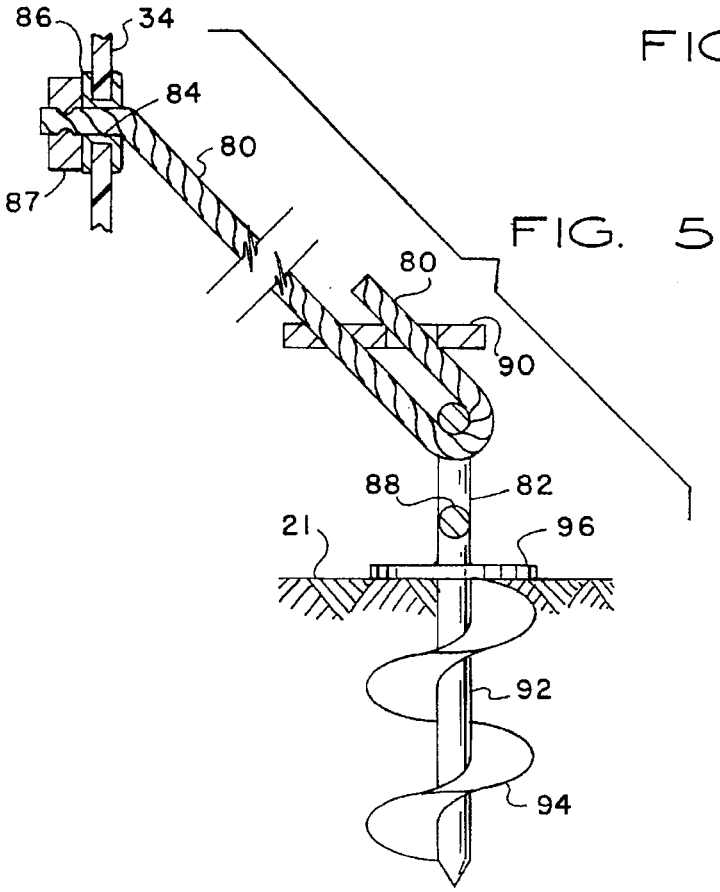
FIG. 5 is a section view taken generally from the line 5—5 of FIG. 2.

Referring again to FIG. 2, and also FIG. 5, the barrier wall 34 is also preferably supported by a plurality of flexible retaining lines 80 which are spaced apart along the barrier wall as indicated and are connected to the barrier wall adjacent a longitudinal side edge 34*a* thereof. The retaining lines 80 are preferably arranged to depend at a suitable angle to the earth's surface 21 and are anchored thereat by suitable anchors 82. The barrier retaining lines 80 are preferably formed of a suitable synthetic rope material such as nylon, Dacron or polyethylene and spaced apart a distance of about 3.0 feet to 5.0 feet along the length of the barrier wall 34.

As shown in FIG. 5, the barrier wall 34 is provided with additional spaced apart reinforced openings 84, one shown, preferably defined by conventional metal grommets 86. The retaining lines 80 are each provided with a becket or other suitable retainer 87 at one end, are trained through a suitable eye 88 in the anchor 82 and tensioned and secured by a suitable guide release retainer 90 of conventional design. As shown in FIG. 5 the anchor 82 is preferably of the spiral or auger type having an elongated rodlike shank 92 and at least one spiral auger flight 94 formed thereon. A suitable cylindrical flange or collar 96 is formed between the eye 88 and the shank 92 in a conventional manner. Other types of anchors may be used to secure the retaining lines 80.

Figure 6:
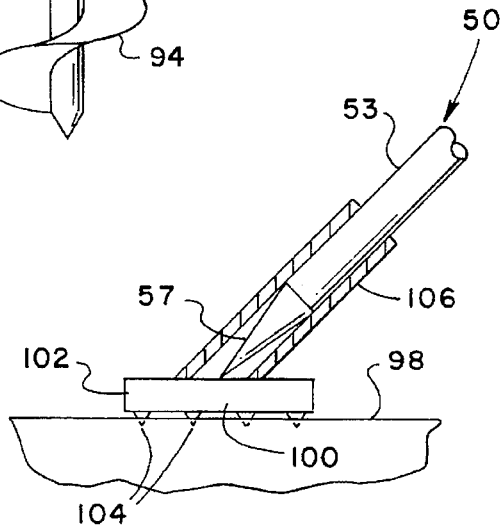
FIG. 6 is a detail view of a foot for use with the barrier support poles.

Referring briefly to FIG. 6, one or more of the support pole assemblies 50 may be secured to a section of barrier wall 34 which is disposed over a hard surface, such as a concrete roadway 98, in which case the sharp tapered end 57 of a pole section would not penetrate the surface and provide adequate support. In this instance a pole support foot 100 is provided having a substantially flat plate portion 102 with suitable surface engaging teeth 104 formed on the bottom thereof. A generally tubular pole receiving member 106 extends upward from the plate member 102 at a suitable angle with respect to the surface corresponding to the angle between the depending leg portion 53 or 55 of the respective pole members 52 and 54 and the surface 98 for receiving the distal end of a pole number, as indicated.

Figure 7:
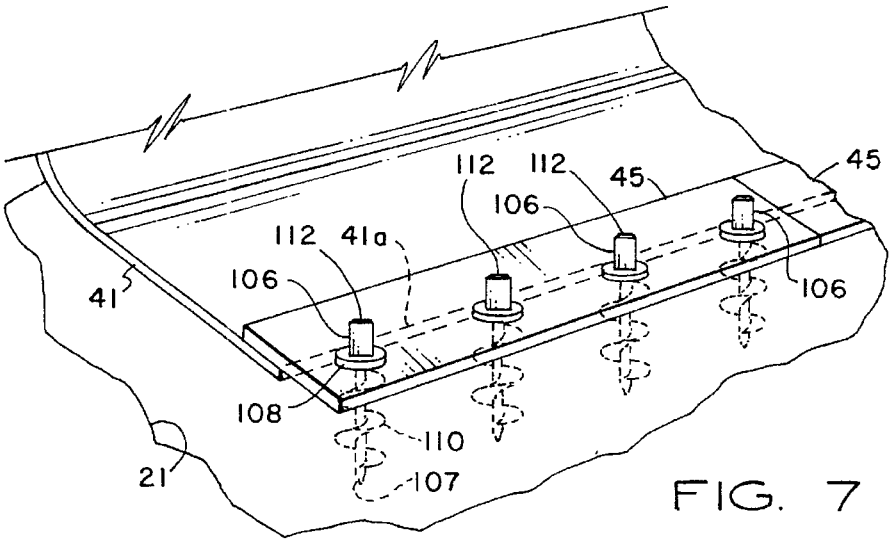
FIG. 7 is a perspective view showing certain details of an arrangement for securing the distal edge of the barrier liner to the earth's surface.

FIG. 7 illustrates one preferred arrangement for securing the distal longitudinal edge 41*a* of the skirt or liner 41 to the earth's surface 21. The elongated retainer plates 45 are preferably provided with suitable spaced apart openings for receiving anchor members 106 similar to the anchors 82. Retaining collars 108 are formed on the anchors 106 and spiral auger flights 110 depend from the collars 108 and disposed around suitable shank portions 107. The anchors 106 also include upwardly projecting tang portions 112 operable to be engaged by a suitable tool, not shown, for augering the anchors 106 into the earth to secure the retainer plates 45 and the liner 41 in sealing engagement with the earth's surface at least at the edge 41*a*. If the liner 41 is disposed over a paved surface or the like, other suitable means, such as sandbags, may be used to secure the edge 41*a* to such a surface.

Referring now to FIGS. 8, 9 and 9A, opposite ends of barrier sections 28 are sealingly connected to each other by a unique connector member, generally designated by the numeral 120. Each connector member 120 comprises an elongated, generally rectangular rigid plastic or metal plate 122 having spaced apart sets of fastener receiving openings for receiving suitable threaded fasteners 126 with quick attachment and detachment members such as wing nuts 128, FIG. 9. Each distal edge 35 and 37 of a barrier section 28 has arranged therealong suitable openings 130, FIG. 9A, for receiving the fastener assemblies 126. As also shown in FIG. 9A, the lateral edge 132 of the liner 41 is provided with spaced apart openings 134 for receiving fasteners 126 to secure the lateral edge of the skirt or liner 41 to a depending arm 136 of the connector 120. The liner 41 is left unconnected to the barrier wall 34 for a short distance back from the distal edge 132, as indicated at 135, see FIG. 9A, so that the edge 132 of the liner can be slipped under the connector arm 136 for connection thereto. The spacing of the openings 130 and 134 and the pliability of the fabric reinforced plastic material of the barrier wall 34 and the liner 41 is such that a substantially water tight seal is provided at the connections between the connector 120 and the ends 35 and 37 of each barrier section 28.

Figure 10:
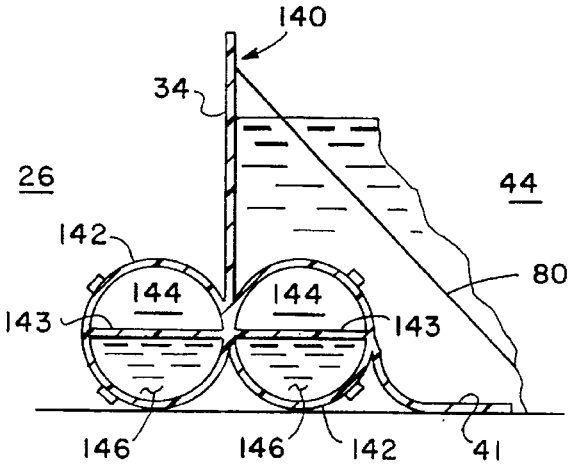
FIG. 10 is a transverse section view of an embodiment of the barrier similar to that shown in FIG. 2.

Referring now to FIG. 10, there is illustrated a transverse cross section of a barrier section 140 similar in most respects to the barrier section 28 and having a generally vertically extending barrier wall 34 suitably secured to or formed integral and parallel with contiguous, generally cylindrical tubular ballast members 142. The ballast members 142 are similar to the ballast members 30 with the exception that the interior spaces of the ballast members 142 are divided by an elongated flexible web 143 to form spaces 144 and 146. The spaces 146 may be filled with a dense fluid, such as water and the spaces 144 are preferably filled with pressure air to add rigidity and height to the ballast members while not requiring that they be filled completely with a dense liquid.

Figure 11:
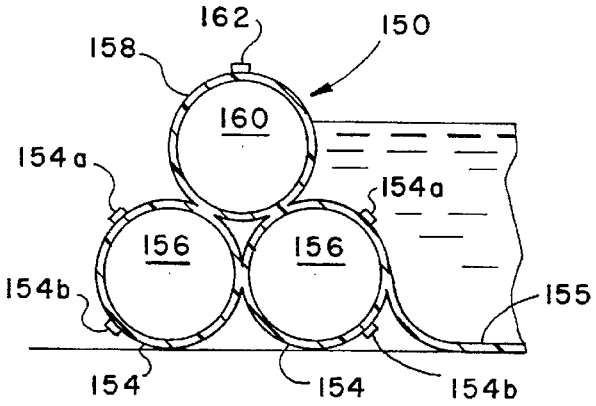
FIG. 11 is a transverse section view of a first. alternate embodiment of a barrier system in accordance with the invention.

Referring briefly to FIG. 11, another embodiment of the invention is illustrated and generally designated by the numeral 150. The flood control barrier system 150 includes an elongated barrier section 152 similar in some respects to the barrier sections 28 and 140 except that the barrier section 152 includes two elongated, parallel and interconnected tubular ballast members 154, each forming interior spaces 156 which may be filled with a dense fluid, such as water, through suitable fill and drain ports 154*a* and 154*b*. A third flexible tubular barrier member 158 is disposed above and connected to the ballast members 154 and is adapted to have its interior space 160 filled with pressure air through a suitable fitting 162. The flood control barrier system 150 also includes an elongated skirt or liner 155 suitably connected to one of the ballast members 154 in the same manner that the liner 41 is connected to a ballast member 30 or 142. The flood control barrier system 150 is adapted to be used in situations where relatively low floodwater height is expected. Alternatively, the diameters of the ballast members 154 and the barrier member 158 may be substantially more than the diameters of the ballast members 30, for example, wherein the overall height of the barrier 150 may be about the same as the barrier system 24.

Figure 12:
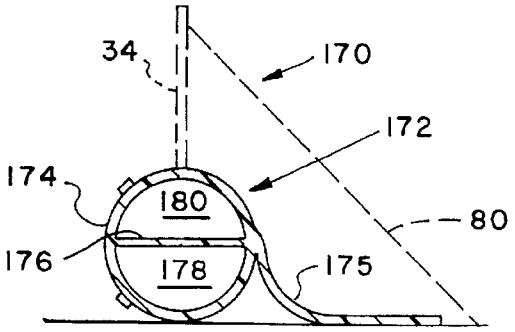
FIG. 12 is a transverse section view of a second alternate embodiment of a barrier system in accordance with the invention.

Referring to FIG. 12, there is illustrated an embodiment of the present invention comprising a flood control barrier system 170 having a barrier section 172 characterized by a single elongated, inflatable, generally cylindrical ballast member 174 which may have an interior partition 176 dividing the member 174 into a ballast chamber 178 and an inflation chamber which may be filled with water and compressed air, respectively. The ballast member 174 has an elongated water impervious flexible liner member 175 attached thereto in the same manner as the barrier sections of the barrier systems 24, 140 and 150. Each of the barrier sections of the systems 140, 150 and 170 may be connected to each other with a connector similar to the connector 120 and dimensioned to accommodate the configuration of the respective barrier sections. Basically, such connectors would be similar to the connector 120 but would not have a height any greater than required to connect the ends of the barrier sections to each other in a manner similar to that shown in FIGS. 8, 9 and 9A and described hereinabove.

Figure 13:
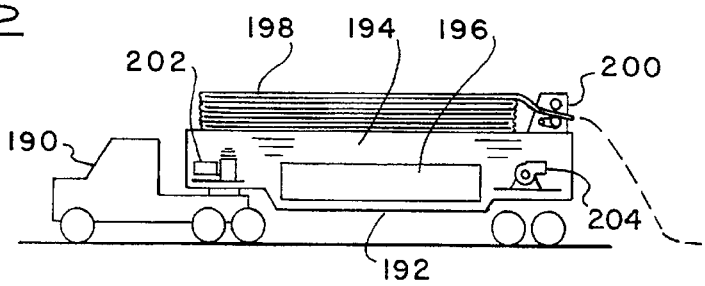
FIG. 13 is a side elevation of a transport vehicle for the barrier system of the present invention.

Referring now to FIG. 13, there is shown a vehicle adapted to be used in conjunction with deploying the flood control barrier system 24 or any of the alternate embodiments of the system described hereinabove. A preferred method of deploying the system 24 includes utilization of a roadable motor vehicle comprising a tractor unit 190 of conventional construction adapted to tow a semi-trailer 192 including an elongated closed tank 194 for carrying ballast liquid therein, such as water. Suitable storage compartments 196, one shown, are secured to the trailer 192 for carrying certain parts of the barrier system 24, such as the support pole assemblies 50, the retaining lines 80, the retaining plates 45 and related anchor members and the connectors 120, for example. The flexible and inflatable barrier sections 28 are preferably stored, stacked and folded onboard the trailer 192 as indicated at 198 and may be deployed from the trailer by suitable payout and retrieval mechanism 200 mounted on top of the trailer.

Accordingly, when it is desirable or necessary to deploy the barrier system 24 in an area which is subject to flooding, the transport vehicle 190, 192 may be parked in the vicinity of the perimeter of the area to be contained or enclosed by the barrier system and the barrier sections 28 may be offloaded from the trailer 192 using the payout and retrieval mechanism 200. As each barrier section 28 is deployed it is connected to the adjacent barrier section by a connector 120 and erection is begun by connecting successive ones of the support pole assemblies 50 to the barrier walls 34 of each barrier section. As the barrier section 28 are erected suitable hose means, not shown, may be connected to the tank 194 and to the ballast members 30, for example, and ballast liquid pumped into the interior spaces of the ballast members. This method is carried out, particularly, when a source of ballast liquid, such as water, is not otherwise readily available in the immediate vicinity of the barrier system erection site. Pressure air may also be communicated to the ballast members, if such is needed, as with the embodiments of FIGS. 10, 11 and 12. The trailer 192 may have suitable onboard compressor and pump means 202 and 204, respectively, for pumping the respective fluids required into the respective members of the barrier system.

When the barrier system 24, for example, is no longer required the support pole assemblies 50 are disassembled, the retaining lines 80 released, the retainer plates 45 removed, together with the respective anchors for the retaining plates and the retaining lines, the connectors 120 are disconnected from each barrier section and the fluids are drained from the ballast members 30. Each barrier section is then retrieved for storage on the trailer 192 by the payout and the retrieval mechanism 200.

Although preferred embodiments of a unique flood control barrier system and components thereof have been described in detail herein, one skilled in the art will recognize that various substitutions and modifications may be made to the system and its components without departing from the scope and spirit of the appended claims.

What is claimed is:

1. A portable flood control barrier system characterized by:

at least one elongated flexible inflatable ballast member operable to be disposed on the earth's surface, said ballast member forming a closeable chamber which may be filled with a ballast fluid;

a generally planar flexible sheet barrier wall connected to said at least one ballast member and adapted to be extended substantially vertically upward from said at least one ballast member; and means connected to said barrier wall at spaced apart points thereon for supporting said barrier wall in a substantially vertical erect position above said at least one ballast member to prevent flooding of a space adjacent to said barrier system.

2. The system set forth in claim 1 wherein:

said barrier system includes plural barrier sections each comprising said at least one ballast member and said barrier wall and adapted to be connected end to end to form said barrier system; and connector means adapted to be connected to respective adjacent ends of said barrier sections for forming a substantiality fluid tight connection of said barrier sections to each other.

3. The system set forth in claim 1 wherein:

said at least one ballast member comprises an elongated flexible tube.

4. The system set forth in claim 3 wherein:

said tube includes an interior partition forming respective chambers in said at least one ballast member, one of said chambers being adapted for receiving ballast fluid and the other chamber being adapted to receive pressure air.

5. The system set forth in claim 1 wherein:

said at least one ballast member comprises two elongated flexible tubes secured to each other side by side and to said barrier wall.

6. A portable flood control barrier system comprising:

a plurality of barrier sections, each of said barrier sections comprising at least one elongated flexible ballast member operable to be disposed on the earth's surface, said at least one ballast member forming a closable chamber, and a barrier wall connected to said at least one ballast member and adapted to be supported extending substantially vertically from said at least one ballast member;

connector means for connecting said barrier sections end to end to form an elongated barrier; and means for supporting said barrier wall in a substantially erect position comprising spaced apart rigid pole assemblies connected to said barrier wall and extending from opposite sides of said barrier wall to engagement with the earth's surface at points spaced from said at least one ballast member.

7. The barrier system set forth in claim 6 including:

an elongated liner extending along said at least one ballast member and adapted to be deployed laterally from said at least one ballast member in engagement with the earth's surface to minimize water saturation and erosion of the earth's surface adjacent to said at least one ballast member.

8. The system set forth in claim 6 including:

a plurality of elongated flexible retaining lines adapted to be connected to said barrier wall at spaced apart points therealong and to anchor means disposed on the earth's surface.

9. The barrier system set forth in claim 6 wherein:

said at least one ballast member comprises at least two elongated flexible tubes secured to each other side by side and to said barrier wall.

10. A method for providing a temporary barrier to the encroachment of floodwater on a predetermined area of the earth comprising the steps of:

providing at least one elongated flexible flood control barrier section comprising a tubular ballast member and a tubular barrier member connected to said ballast member and substantially coextensive with said ballast member;

deploying said at least one barrier section on the earth's surface;

filling said ballast member with a ballast liquid to cause said ballast member to be in forcible engagement with the earth's surface; and inflating said barrier member with pressure gas to increase the height of said at least one barrier Section to prevent flooding said predetermined area.

11. The method set forth in claim 10 including the steps of:

draining ballast fluid from said ballast member; disconnecting said barrier sections from each other; and removing said barrier sections from said predetermined area.

12. A portable flood control barrier system characterized by:

at least one elongated flexible inflatable ballast member operable to be disposed on the earth's surface, said ballast member forming a closeable chamber which may be filled with a ballast fluid;

flexible barrier wall means adapted to be extended substantially vertically upward from said ballast member; and means comprising substantially rigid pole means connected to said barrier wall means at spaced apart points there-along for supporting said barrier wall means in a substantially vertical erect position to prevent flooding of a space adjacent to said barrier system.

13. The system set forth in claim 12 wherein:

said pole means comprises opposed barrier wall support poles adapted to be connected to each other and to said barrier wall means at spaced apart points, respectively, therealong.

14. A portable flood control barrier system characterized by:

at least one elongated flexible inflatable ballast member operable to be disposed on the earth's surface, said ballast member forming a closeable chamber which may be filled with a ballast fluid;

flexible barrier wall means adapted to be extended substantially vertically upward from said at least one ballast member; and means including flexible retaining lines connected to said barrier wall means and to anchor means at spaced apart points along said barrier wall means for supporting said barrier wall means in a substantially vertical erect position to prevent flooding of a space adjacent to said barrier system.

15. A portable flood control barrier system characterized by:

at least one elongated flexible inflatable ballast member operable to be disposed on the earth's surface, said at least one ballast member forming a closeable chamber which may be filled with a ballast fluid;

a liner connected to said at least one ballast member and adapted to be spread along the earth's surface adjacent said at least one ballast member to minimize water saturation or erosion of the earth's surface adjacent said at least one ballast member;

liner retaining means adapted to secure a distal edge of said liner to the earth's surface comprising elongated retaining plate means and respective spaced apart anchors connected to said retaining plate means for securing said retaining plate means to the earth adjacent said distal edge of said liner;

flexible barrier wall means adapted to be extended substantially vertically upward from said at least one ballast member; and means for supporting said barrier wall means in a substantially vertical erect position to prevent flooding of a space adjacent to said barrier system.

16. A portable flood control barrier system characterized by:

at least one elongated flexible inflatable ballast member operable to be disposed on the earth's surface, said at least one ballast member forming a closeable chamber which may be filled with a ballast fluid;

flexible barrier wall means adapted to be extended substantially vertically upward from said at least one ballast member, said barrier wall means including elongated, spaced apart, substantially stiff batten members disposed thereon for providing substantially vertical stiffness to said barrier wall means; and means for supporting said barrier wall means in a substantially vertical erect position to prevent flooding of a space.

17. A method for providing a temporary barrier to the encroachment of floodwater on a predetermined area of the earth comprising the steps of:

deploying a plurality of elongated flexible flood control barrier sections, each comprising at least one elongated tubular ballast member adapted to be filled with a ballast fluid and barrier wall means connected to said at least one ballast member and adapted to be disposed above said at least one ballast member to provide a minimum height of flood control barrier when said at least one ballast member is disposed on the earth's surface;

connecting said barrier sections to each other end to end;

filling said at least one ballast member with a ballast fluid to cause said at least one ballast member to be in forcible engagement with the earth's surface; and supporting said barrier wall means in a substantially erect position with spaced apart support means disposed on at least one side of said barrier wall means.

18. A method for providing a temporary barrier to the encroachment of floodwater on a predetermined area of the earth comprising the steps of:

deploying a plurality of elongated flexible flood control barrier sections, each comprising at least one elongated tubular ballast member adapted to filled with a ballast fluid and barrier wall means connected to said ballast member and adapted to be disposed above said at least one ballast member to provide a minimum height of flood control barrier when said at least one ballast member is disposed on the earth's surface;

connecting said barrier sections to each other end to end; and filling said at least one ballast member with a ballast fluid to cause said at least one ballast member to be in forcible engagement with the earth's surface.

inflating said barrier wall means to increase the rigidity of said barrier sections and to increase the height of said barrier sections to prevent flooding said predetermined area.

19. A method for providing a temporary barrier to the encroachment of floodwater on a predetermined area of the earth comprising the steps of:

providing a plurality of elongated flexible flood control barrier sections, each comprising at least one elongated tubular ballast member adapted to be filled with a ballast fluid and barrier wall means connected to said at least one ballast member and adapted to be disposed above said at least one ballast member to provide a minimum height of flood control barrier when said at least one ballast member is disposed on the earth's surface;

providing a transport vehicle for said barrier sections, said transport vehicle including means for off-loading said barrier sections therefrom, means for transporting a quantity of ballast fluid and pump means for pumping ballast fluid from said transport vehicle to said barrier sections;

transporting said temporary barrier to said predetermined area with said transport vehicle;

off-loading said barrier sections from said transport vehicle;

deploying said barrier sections on the earth's surface;

connecting said barrier sections to each other end to end; and filling said at least one ballast member with a ballast fluid to cause said at least one ballast member to be in forcible engagement with the earth's surface.

20. The method set forth in claim 19 wherein:

the step of filling said at least one ballast member with ballast fluid comprises filling said at least one ballast member with ballast fluid from said transport vehicle by pumping said ballast fluid from said transport vehicle to said at least one ballast member with said pump means.

21. The method set forth in claim 19 wherein:

said transport vehicle includes gas compressor means disposed thereon and said method of deploying said barrier sections includes the step of inflating at least one of said at least one tubular balast member and said barrier wall means with pressure gas from said compressor means.

* * * * *